United States Patent [19]

Folkmar

[11] Patent Number: 4,887,335

[45] Date of Patent: Dec. 19, 1989

[54] CLOSURE FOR CLOSING PLASTIC BAGS AND THE LIKE

[75] Inventor: Jan Folkmar, Otelfingen, Switzerland

[73] Assignee: ICE-PACK Service AG, Otelfingen, Switzerland

[21] Appl. No.: 278,650

[22] Filed: Nov. 15, 1988

[30] Foreign Application Priority Data

Nov. 16, 1987 [DE] Fed. Rep. of Germany ..... 3738881

[51] Int. Cl.[4] ..... B65D 77/10

[52] U.S. Cl. ..... 24/30.5 R; 24/543

[58] Field of Search ..... 24/30.5 R, 30.5 P, 487, 24/542, 559, 543, 556, 561, 562; 383/78, 81, 63, 68

[56] References Cited

U.S. PATENT DOCUMENTS

| | | | |
|---|---|---|---|
| D. 276,596 | 12/1984 | Kisha | 24/30.5 P X |
| 600,887 | 3/1898 | Pettit | 24/561 X |
| 1,600,684 | 9/1926 | McGibbon | 24/543 |
| 1,815,774 | 7/1931 | Heard | 24/556 |
| 4,523,353 | 6/1985 | Hubbard et al. | 24/543 |

FOREIGN PATENT DOCUMENTS 2554392 4/1977 Fed. Rep. of Germany .

*Primary Examiner*—James R. Brittain

*Attorney, Agent, or Firm*—Townsend and Townsend

[57] ABSTRACT

A closure for closing plastic bags or the like consists of two clamping legs connected together via a joint and a lock for holding the clamping legs in mutual engagement, the one clamping leg being provided with a recess extending along the axis of the clamping leg and the other clamping leg being provided with a rib which extends along its axis and which is adapted to be moved into the recess by movement of the two clamping legs towards each other, a member of the lock being formed on one clamping leg and the other member on the other clamping leg. The first clamping leg having a recess has a substantially U-shaped cross-section, the sidewalls of the first clamping leg with U-shaped cross-section are extended by lips in the plane of the respective wall, the thickness of the lips is less than the thickness of the walls; the second leg comprising the rib has a substantially V-shaped profile and the clear internal width of the U-shaped first clamping leg is less than the clear external width of the second clamping leg.

7 Claims, 2 Drawing Sheets

CLOSURE FOR CLOSING PLASTIC BAGS AND THE LIKE

Figure 1:
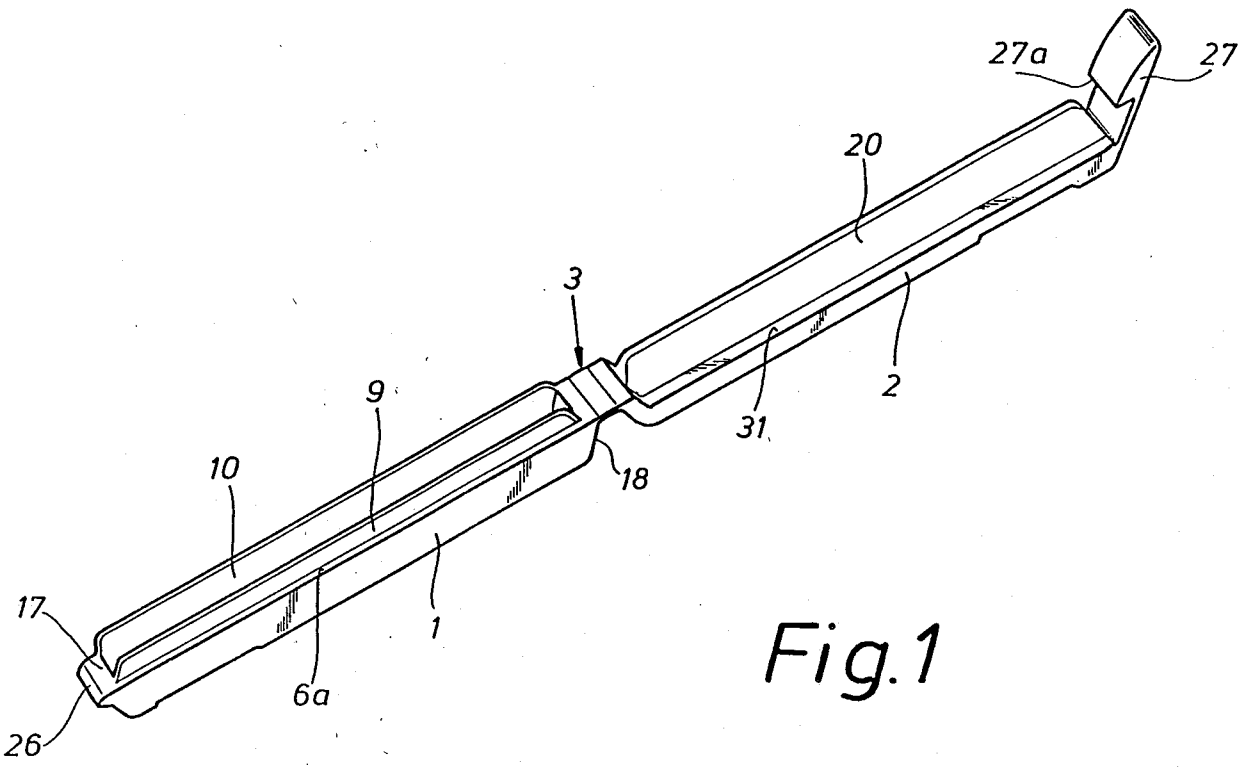

The invention relates to a closure means for closing plastic bags or the like.

A closure means or fastener for closing plastic bags or the like is known from U.S. Pat. No. 4,296,529. In this closure means one leg is provided with a recess and the other leg with a rib so that by a movement of the two legs towards each other the rib can be moved into the recess, clamping in an element to be closed, in the form of a bag or the like. The leg carrying the rib has substantially the form of a "T", the portions projecting laterally away from the rib limiting the depth to which the rib can engage into the recess of the other leg. Such a closure means requires the use of teeth for firmly clamping the bag to be closed and the bag can be damaged. The teeth are necessary to avoid tolerance problems between the rib and the recess in the leg opposite the rib. Another disadvantage is that in this closure means for locking the two clamping legs in the closure state frictional forces are utilized between a nose and a friction surface. To prevent unintentional springing open of the closure means the frictional force or clamping force between the nose and friction surface must be very high and this makes handling difficult.

EP-A-No. 0 156 779 discloses a closure means in which one leg contains a substantially V or Y-shaped recess whilst the other leg has two flexible ribs which are parallel to each other and which for closing a bag or the like are moved into the V or Y-shaped recess with clamping of the bag portion to be closed. Such a closure means has a complicated profile an can only be made with high material and tool costs.

DE-OS No. 2,554,392 discloses a closure means for plastic bags which consists of two legs, each of the two legs carrying part of a detent means which can be brought into engagement with each other by pivoting the two legs towards each other. The fact that the detent means serves directly as closure means for the plastic bags and at the same time forms the detent means itself results in the disadvantage that opening of the closure means is difficult because of lack of accessibility of the detent means. In particular, such a closure means is not suitable for repeated opening and closure. An opening of the closure means can be achieved only by applying a relatively high force.

The problem underlying the invention is to provide a closure means which avoids the aforementioned disadvantages.

This problem is solved according to the invention in that the first clamping leg having the recess has a substantially U-shaped cross-section, that the side walls of the first clamping leg with U-shaped cross-section are extended by lips within the plane of the respective wall, that the thickness of the lips is less than the thickness of the walls, that the second leg comprising the rib has a substantially V-shaped profile and that the clear internal width of the U-shaped first clamping leg is less than the clear external width of the second clamping leg.

Further developments of the subject of the invention are set forth in the subsidiary claims.

The invention provides a closure means, in particular for bags of plastic, for icecube freezer bags or the like, which has a relatively simple structure, permits easy opening by actuating a detent means disposed outside the clamping surface and in particular provides a fluid-tight, more especially liquid-tight sealing of plastic bags or the like.

Figure 2:
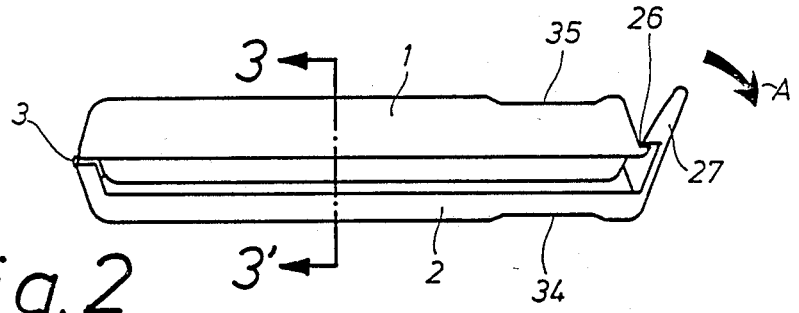
Figure 3:
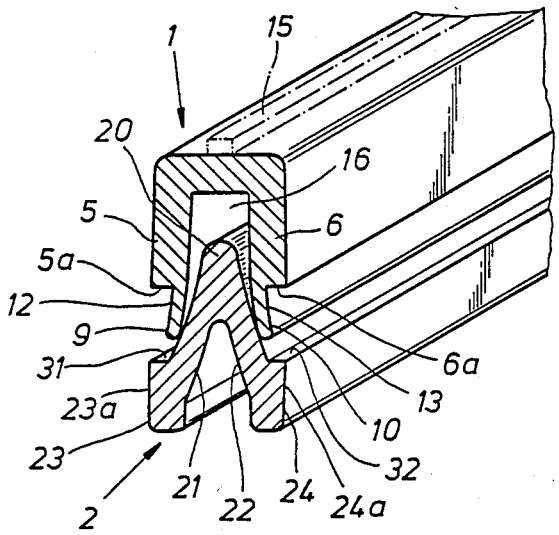
Figure 4:
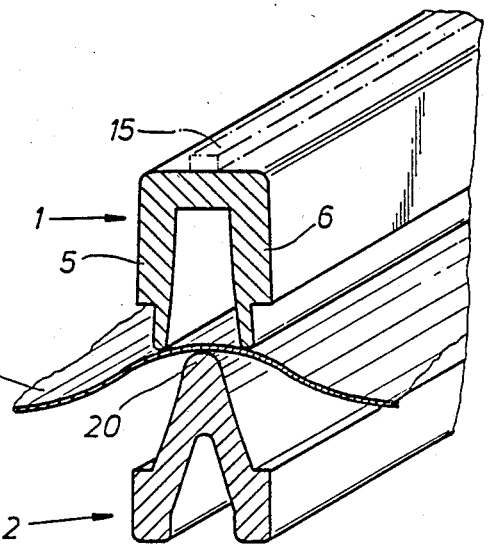

Hereinafter preferred embodiments of the closure means according to the invention will be described with reference to the drawings to explain further features, wherein:

FIG. 1 is a perspective view of a preferred embodiment of the closure means in the completely opened state, FIG. 2 is a side view of the closure means according to FIG. 1 in the closed state, i.e. for fluid-tight closure of a bag opening, the bag not being shown, FIG. 3 is a sectional view along the line 3–3' in FIG. 2, and FIG. 4 is a sectional view corresponding to FIG. 3, the two legs of the closure means including an angle of about 35°.

According to FIGS. 1 to 3 the closure means according to the invention consists of a first clamping leg 1 and a second clamping leg 2 which are connected together pivotally with respect to each other via a joint 3. The joint 3 may for example be a hinge axis defined by a weakening line or the like. Such articulate connections are known per se from U.S. Pat. No. 4,296,529 or EP-A-No. 0 156 779.

The closure means consisting of the clamping legs 1,2 and the joint 3 are preferably made integrally and consist preferably of plastic, for example polyamide, but may also be made from stronger plastic.

The clamping leg 1 preferably has seen in cross-section the form of a "U" with walls 5,6 which are parallel to each other and connected together by means of a base 7. In accordance with FIG. 3 the walls 5,6 project vertically from the base 7 connecting them. According to a modified embodiment the walls 5,6 may advantageously be slightly inclined with respect to each other so that the two walls 5,6 extend substantially V-shaped outwardly from the base 7 connecting them (FIG. 3).

The clamping leg 1 thus has substantially the form of a channel, the longitudinal edges *5a,6a* of the walls 5,6 remote from the base 7 being provided with lips 9,10 which extend out of the walls 5,6. The lips 9,10 have a small height compared with the height of the walls 5,6 and a small thickness compared with the thickness of the walls 5,6 so that they are more flexible than the latter. In particular, the lips 9,10 in accordance with FIG. 3 are extended from the walls 5,6 in the direction towards the second clamping leg 2 in such a manner that the inner surface of each wall 5 or 6 aligns with the inner surface of the associated lip 9 and 10 respectively whilst between the outer surface of the wall 5 or 6 and the outer surface 12,13 of the lips 9 or 10 a step *5a,6a* is formed. In this manner the lips 9, 10 have a substantially higher elasticity than the walls 5, 6 and in the manner still to be described permit sealing engagement on the opposite clamping leg 2.

To avoid an arcuate sagging of the clamping leg 1 when made from a softer or flexible plastic material said leg 1 may be provided at its outwardly directed face of the base 7 with a reinforcing rib 15 as indicated in FIG. 3. The recess 16 defined by the two walls 5,6 serves to receive or at least partially receive the clamping counter member of the second clamping leg 2. The recess 16 on the side of the joint 3 and on the opposite side of the clamping leg 1 is closed in each case by a corresponding wall 17 and 18 respectively.

The second clamping leg 2 has in accordance with the embodiment illustrated in the Figures a substantially V-shaped profile. Said V-shaped profile of the clamping leg 2 defines a longitudinal rib or a web 20 from which two inclined walls 21,22 project. At their lowest side (FIG. 3) the two walls 21,22 each merge into a web of preferably rectangular cross-section which is denoted by 23 and 24 and in the clamping position shown in FIG. 3 defines in each case at least one surface 23*a*,24*a* in alignment with the outer surface of the associated wall 5,6. On the second clamping leg 2 on the side thereof remote from the rib 20 a substantially V-shaped recess is formed through which if required reinforcing transverse ribs may pass.

By pivoting the clamping leg 1 or 2 in the direction towards the other clamping leg the closure means according to FIG. 1 is brought into the position illustrated in FIG. 2 in which a clamping force is exerted on the included bag or the like. To retain the closure state the closure means is provided with a detent or locking means. The detent means consists in the embodiment shown of a detent nose 26 which is formed on one of the two clamping legs and in this case is provided at the free end of the clamping leg 1 and denoted by 26. The associated detent member is provided at the free end of the other clamping leg 2 and denoted by 27. The detent member 27 consists of an extension which according to FIG. 1 projects inclined from the free end of the clamping leg 2 and a detent recess 27*a* into which the detent nose 26 can be moved. Due to a lever-like articulation of the detent member 27 the latter is given a certain elasticity which ensures snapping of the detent nose 26 into the detent recess 27*a* and permits release of the detent means by slight movement of the detent member 27 clockwise in FIG. 1. Consequently, to release the detent means in accordance with FIG. 2 the detent member 27 in the form of a lever is to be moved slightly in the direction of an arrow A, the detent nose 26 thereby being brought out of engagement with the detent recess 27*a*. Thereafter the two clamping legs 1,2 can be pivoted opposite to each other about the joint 3 into the opened state.

FIG. 4 shows a perspective sectional view of a partially opened closure means, a plastic bag being illustrated between the two clamping legs 1,2 to show how a clamping action is exerted on said plastic bag by the two clamping legs 1,2. It can be seen that for fluid-tight closure of the plastic bag the two clamping legs 1,2 must be move further towards each other until the rib 20 on the one hand and the two ribs 9,10 on the other adequately clamp the plastic bag 30.

The webs 23,24 comprise extensions or steps 31,32 extending perpendicularly to the surfaces 23*a*,24*a* which in the state shown in FIG. 1 or 3 lie substantially parallel to the base 7. Said steps 31,32 may be provided as limitation of the movement of the two clamping legs 1,2 towards each other. A limitation of the movement comes into effect when the upper edge of the lips 9,10 come to bear on said steps 31, 32.

Advantageously, the width of the webs 23,24 shown in FIG. 3 in cross-sectional view is made substantially as great as the thickness of the walls 5,6 so that the outer dimensions of the two clamping legs are substantially the same, seen in transverse direction. It is further apparent from FIG. 3 that the lips 9,10, at least in the state corresponding to FIG. 2, bear sealingly on the outer surfaces of the walls 21,22 and thus when the bag is interposed press the latter in fluid or in particular liquid-tight manner in the region of the closure means against the walls 21,22 of the V-shaped clamping leg due to the action of the lips 9,10.

To achieve a still better clamping action substantially in the centre of the clamping legs 1,2 with respect to the axis of said legs 1,2 the lip 9 an/or the upper edge of the lips 9,10 may be made arcuate as indicated in dashed line in FIG. 1 for the rib 20. The maximum height of the rib 20 and/or of the lips 9,10 is achieved substantially halfway along the length of the clamping legs 1,2, i.e. the apex lies substantially in the centre of the longitudinal axes of the clamping legs 1,2. Finally, for better manipulation of the closure means the two clamping legs may be provided at their face lying outwardly in FIG. 2 with grip depressions 35,36, said grip depressions 35,36 lying near the lateral detent means 26,27.

The invention provides a closure means, in particular for plastic bags, such as icecube freezer bags, which after the filling of such icecube freezer bags with water is adapted to seal the plastic bag in liquid-tight manner before the icecube bag is inserted into the ice compartment. The closure means has a simple structure and requires simple moulding tools for production of the two clamping legs to ensure adequate clamping force between said legs. In particular, the provision of the two lips 9,10 as extension of the wall 5,6 contribute substantially to exerting a good clamping force onto the bag disposed between the clamping legs and ensuring a liquid-tight closing of the plastic bag without any danger of damage thereto. The danger of damaging the plastic bag to be sealed is additionally eliminated in that the free edges of the lips 9,10 are rounded as apparent from FIG. 3.

The closure means according to the invention can be locked in simple manner in the clamping state by the detent means 26,27 and due to the detent means according to the invention simple easy opening of the closure means is possible by slightly moving the lever 27. The closure means according to the invention can thus easily be locked and released from its locking position and is thus readily reusable.

To obtain an adequate clamping action between the first clamping leg 1 and the second clamping leg 2 the inner clear width of the first clamping leg 1, i.e. distance between the walls 5,6 defining the recess 16, is preferably made smaller than the outer spacing of the second clamping leg 2 in the region of the intersection line between the surfaces 31 and the outer surface of the wall 21 or the surface 32 and the outer surface of the wall 22. As result, when the V-shaped profile of the second clamping leg engages into the recess 16 according to the illustration in FIG. 3 the lips 9,10 are bent laterally outwardly.

In the illustration of FIG. 1 the two clamping legs 1,2 include an angle of 180° and in the illustration of FIG. 2 the two clamping legs are in engagement with each other, corresponding to an angle of 0°. To achieve these two basic positions according to FIGS. 1 and 2 in accordance with the invention the joint 3 in the 180° position of the two clmaping legs is at a height corresponding substantially to the distance of the step-like surfaces 5*a*,6*a* from the base 7. The surfaces 5*a*,6*a* extend in the embodiment illustrated substantially parallel to the base 7 and in the illustration of FIG. 6 substantially parallel to the surfaces 31,32.

I claim:

1. A closure for closing plastic bags or the like, comprising:

a first clamping leg having first and second ends and a length therebetween, a base and sidewalls joined thereto, which base and sidewalls together form a substantially U-shaped transverse cross-section defining a recess extending substantially the length of the first leg;

each sidewall including, in a plane of the sidewall, a lip having a thickness less than a thickness of the sidewall;

a distance between the sidewall planes defining an interior sidewall width for the first leg;

a second clamping leg having first and second ends and a length therebetween, a rib and sidewalls joined thereto, which rib and sidewalls form a substantially V-shaped transverse cross-section extending substantially the length of the second leg;

a distance between a bag facing surface of said sidewalls of the second leg defining an exterior sidewall width for the second leg, said exterior sidewall width being greater than said interior sidewall width of the first leg;

the first end of the first leg being pivotally joined to the first end of the second leg such that in a bag closing position the first leg overlies and mutually engages the second leg with the bag facing surface of the sidewalls of the second leg lying within the recess of the first leg; and a locking clamp for retaining the first and second legs in mutual engagement in the bag closing position, the clamp including a first member attached to the second end of the first leg, and a second member attached to the second end of the second leg;

a bag to be closed being held between the bag facing surface of the sidewalls of the first leg and the bag facing sidewalls of the second leg when the closure is in the bag closing position.

2. The closure of claim 1, wherein said lips adjoin flush the bag facing surfaces of the sidewalls of the first leg member.

3. The closure of claim 1, wherein a free end of a sidewall of the second clamping leg includes a reinforcing web extending substantially the length of the second leg.

4. The closure of claim 3, wherein an exterior width of the second leg is substantially the same as an exterior width of the first leg when the closure is in a bag closing position.

5. The closure of claim 1, wherein a sidewall of the first leg is inclined with respect to the base of the first leg.

6. The closure of claim 1, wherein the first member of the locking clamp includes a detent nose, and the second member of the locking clamp includes a detent groove sized to receive the detent nose.

7. The closure of claim 6, wherein the second end of the second leg further includes a member projecting at an incline with respect to the rib of the second leg.

* * * * *